US008053709B2

(12) United States Patent
Vandrak et al.

(10) Patent No.: US 8,053,709 B2
(45) Date of Patent: Nov. 8, 2011

(54) HEAT AND/OR LIGHT PRODUCING UNIT POWERED BY A LITHIUM SECONDARY CELL BATTERY WITH HIGH CHARGE AND DISCHARGE RATE CAPABILITY

(75) Inventors: Brian S. Vandrak, Highland Heights, OH (US); Donald C. Haney, Strongsville, OH (US)

(73) Assignee: Enerco Group, Inc., Cleveland, OH (US)

( * ) Notice: Subject to any disclaimer, the term of this patent is extended or adjusted under 35 U.S.C. 154(b) by 370 days.

(21) Appl. No.: 11/954,641

(22) Filed: Dec. 12, 2007

(65) Prior Publication Data

US 2008/0257877 A1 Oct. 23, 2008

Related U.S. Application Data

(60) Provisional application No. 60/874,423, filed on Dec. 12, 2006.

(51) Int. Cl.
*H05B 1/02* (2006.01)

(52) U.S. Cl. ..... 219/533; 219/501; 219/502; 600/353

(58) Field of Classification Search ..... 219/497, 219/494, 501, 506, 202; 600/345, 353
See application file for complete search history.

(56) References Cited

U.S. PATENT DOCUMENTS 4,042,803 A * 8/1977 Bickford ..... 219/211
4,279,255 A * 7/1981 Hoffman ..... 607/112
4,897,378 A 1/1990 Chiang
4,994,433 A 2/1991 Chiang
5,079,195 A 1/1992 Chiang et al.
5,509,555 A 4/1996 Chiang et al.
5,813,454 A * 9/1998 Potter ..... 165/276
D409,819 S 5/1999 Gilchrist
5,906,202 A * 5/1999 Schuster et al. ..... 128/203.23
6,231,779 B1 5/2001 Chiang et al.
6,599,662 B1 7/2003 Chiang et al.
6,648,635 B2 11/2003 Vandrak et al.
6,787,232 B1 9/2004 Chiang et al.
7,026,071 B2 4/2006 Mayes et al.
7,769,420 B2 * 8/2010 Silver et al. ..... 600/345
2002/0048706 A1 4/2002 Mayes et al.
2003/0082446 A1 5/2003 Chiang et al.
2004/0005265 A1 1/2004 Chiang et al.
2004/0018430 A1 1/2004 Holman et al.
2005/0181280 A1 8/2005 Ceder et al.
2005/0233219 A1 10/2005 Gozdz et al.
2005/0233220 A1 10/2005 Gozdz et al.
2005/0272214 A1 12/2005 Chiang et al.
2006/0102455 A1 5/2006 Chiang et al.

* cited by examiner

*Primary Examiner* — Mark Paschall
(74) *Attorney, Agent, or Firm* — Brouse McDowell, LPA; John M. Skeriotis

(57) ABSTRACT

A portable heating or lighting unit may comprise a housing, a handle, a shield or grid, a source of electric energy, a rectifier, an electrical device adapted to use electrical energy from the source of electric energy, and a control system comprising control hardware and embedded software, where the control system may be adapted to automatically control the electric heating element. A source of electric energy may comprise a battery adapted to store energy and to output stored energy as electrical energy, a fuel cell, a thermoelectric component, or a plug adapted to draw electrical energy from a wall outlet or other source of electrical energy. A battery may be at least partially enclosed by the housing. A thermoelectric component may comprise a thermoelectric material or a thermoelectric generator. An electrical device may comprise a resistive heating element adapted to emit thermal energy.

14 Claims, 5 Drawing Sheets

HEAT AND/OR LIGHT PRODUCING UNIT POWERED BY A LITHIUM SECONDARY CELL BATTERY WITH HIGH CHARGE AND DISCHARGE RATE CAPABILITY

CROSS-REFERENCE TO RELATED APPLICATIONS

This application claims priority to U.S. Ser. No. 60/874,423 entitled Heat And/Or Light Producing Unit Powered By A Lithium Secondary Cell Battery With High Charge And Discharge Rate Capability, filed Dec. 12, 2006. All of the subject matter disclosed by U.S. Ser. No. 60/874,423 is hereby incorporated by reference into this application.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates generally to heat and light producing units and more specifically to a heating or lighting unit or combination thereof deriving at least a portion of its operating or accessory power from an electric source, namely a high capacity lithium secondary cell battery with a high charge rate.

2. Description of Related Art

Various types of heating units are often utilized to provide heat to an enclosure or area. Large enclosed areas are often heated by furnace systems, with the warm air being distributed through simple or extensive ductwork systems throughout the area. Furnaces are often powered by gas, but use electric power to run various functions such as falls used to pass the warm air through the duct systems. When electric power to a home is not available the furnace may not function properly. When power is unavailable, an electric generator may be used to allow for continued use of the furnace and heating system, as well as local lighting systems. However, electric generators are inconvenient to operate, require a gas fuel source that may be unavailable, and pose safety hazards to occupants of the area wherein the generator is being operated. Currently no convenient source of supplemental electric power exists for continued heating or lighting of an enclosure during a power outage or when power service is otherwise unavailable.

Portable heating units, also called space heaters, are commonly used to provide heat to a localized area and are typically freestanding and self-contained units that operate independently of any duct heating system that may exist in the localized area intended to be heated by the space heater. Space heaters are often used as a supplemental heat source for enclosed, interior settings and as the sole heat source for outdoor unenclosed areas or unheated enclosed areas such as patios, decks, unheated cabins, garages, tents and sheds. The small size of space heaters provides portability and convenience for transporting the heater to remote locations for activities such as camping and hunting.

Portable lighting units, such as lanterns or lamps, are used to provide light to a localized area and are typically freestanding and self-contained units that operate independently of any electrical system that may exist in the localized area intended to be lit by the portable unit. Portable light units are often used to supplement light for enclosed interior settings and as the sole light source for outdoor unenclosed areas or unlit enclosed areas such as patios, decks, unlit cabins, garages, tents and sheds. The portable nature of the lighting units makes them convenient to transport to remote locations for activities such as hunting and camping.

Most portable heating units and portable lighting units require a fuel source such as propane, kerosene, gasoline, or other type of compressed gas or combustible liquid that is continuously consumed at all times during operation thereof. The fuel source is commonly ignited in a combustion chamber by a spark or constant flame. As the fuel burns in such heating units, for example, it creates all the thermal energy necessary to cause the heating elements to rise in temperature and begin to dissipate the heat into the surrounding area, thereby heating the area in which the space heater is located. Some portable heaters also have forced air capabilities, employing a fan or other method to force warm air out of the heating unit and into the surrounding environment to expedite the heating of the ambient environment.

Portable heating units and portable light producing units are often transported to remote locations where it is inconvenient or even impossible to refill the required combustible fuel supply, such as when used in the wilderness while camping or hunting. The user is often not able to continue using the heating or lighting unit for long periods of time, for fear of depleting the fuel supply, and the user may be stranded without any source of heat or light if no replacement fuel supply or alternative heat source is available. Currently, no supplemental or alternative electric energy supply exists that is compact and easy to replace, while producing enough energy to power heating units or light producing units that can consume a combustible fuel during operation thereof. A supplemental or alternative electrical energy supply would allow for a decreased amount of the conventional fide to be burned, alleviating the burden of having to frequently refill the compressed gas source.

Another concern of using a portable heating unit or a light producing unit requiring a combustible fuel source is that as the fuel source burns, chemicals such as carbon monoxide (CO) are released. The chemicals released by the burning fuel increase localized indoor air pollution, which can be aggravated by inadequate ventilation of the area in which the portable heating or lighting unit is used or incomplete combustion of the fuel source. The indoor air pollution created by the portable heater or lighting unit may lead to health hazards such as carbon monoxide poisoning when the oxygen level in the environment becomes dangerously depleted and carbon monoxide levels become dangerously high.

Accordingly, there is a need in the art for a heating unit, a light producing unit, or a combination of a portable heating unit and a light producing unit that includes an alternate electric energy source for supplying at least part, if not all of the energy required to operate the unit. Such a unit would minimize the amount of fuel consumed, thereby minimizing the risk of carbon monoxide poisoning to the user of the unit.

BRIEF SUMMARY OF THE INVENTION

A composition having a heating unit, lighting unit, or combination thereof that derives at least a portion of its operating or accessory power from an electric source that is a high capacity lithium secondary cell battery with a high charge rate.

This invention contemplates the novel concept of providing a high capacity, high charge rate lithium secondary cell battery (also commonly called a lithium ion battery), or other suitably self-contained electric energy source for use as an alternative or supplemental energy source providing at least a portion of the operating or accessory power for a heating unit, a light producing unit, or a combination of a heating and light producing unit. The heating, lighting, or combination of heating and lighting unit powered at least in part by the battery may be permanent or portable, and can be completely or partially powered by the battery. It is foreseen that the battery may be used as the sole source of power to the heating or lighting unit for a limited or extended period of time, or the battery may be utilized simultaneously, consecutively, or sporadically with conventional compressed gas, liquid or other combustible fuel.

The battery may be integrated into the physical structure of the heating, light producing, or combination heating and lighting unit, may be detachable from the physical structure of the unit, or may be on a physically separate structure from the unit. In an embodiment of the invention wherein the lithium secondary cell is integrated fully or partially with the physical structure of the heating, lighting, or combined heating and lighting unit the battery may be accessible or inaccessible, as the recharging process may require the battery to be removed from the unit in certain embodiments, while the battery may be recharged while integrated with the unit in other embodiments. The battery may be electrically connected to the unit by a wire connection, a surface contact connection, a clip connector, or other methods of electrical connection well known within the art.

Within this invention, the battery used to power the heating, light producing, or combined heating and lighting unit can optionally be a high capacity rechargeable lithium secondary cell battery having a high charge rate. In one aspect of the invention, the battery will contain a positive lithium storage electrode and a negative electrode, both capable of reversibly intercalating lithium at a high rate. The battery is designed such that the cell does not plate lithium during charging to avoid a fade reducing capacity of the battery following numerous charge cycles. Thus, the high performance lithium-ion cell is capable of exceptionally high rates of charge and discharge capable of providing energy to operate a heating or lighting unit with repeated, safe and stable charge and discharge.

It is an object of this invention to provide a source of rechargeable electrical power integrated with a heating, lighting, or combined heating and lighting unit such that the source of electrical power may be used as the sole energy source for the heating or lighting unit for a limited or extended period of time, or the electrical power source may be utilized simultaneously, consecutively, or sporadically with conventional compressed gas, propane, kerosene, or other combustible fuels.

It is a further object of this invention to provide a source of rechargeable electrical power integrated with a heating, lighting, or combined heating and lighting unit for continued heating, lighting, or both heating and lighting of an enclosure during a power outage or when the main electrical power service is otherwise unavailable.

It is yet another object of this invention to provide a compact and easily replaceable source of rechargeable electrical power integrated with a portable heating or lighting unit to minimize the use of combustible fuel sources conventionally used to power portable heating, lighting, or combined heating and lighting units in remote locations.

It is yet a further object of this invention to provide a source of rechargeable electrical power integrated with a portable heating, lighting, or combined heating and lighting unit to minimize an amount of conventional compressed fuel or other combustible fuel to be burned, reducing the risk of carbon monoxide poisoning to the user of the heating, lighting, or combined heating and lighting unit.

These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF THE DRAWINGS

The invention may take physical form in certain parts and arrangement of parts, embodiments of which will be described in detail in this specification and illustrated in the accompanying drawings which form a part hereof, and wherein.

DETAILED DESCRIPTION OF ILLUSTRATIVE EMBODIMENTS

Figure 1:
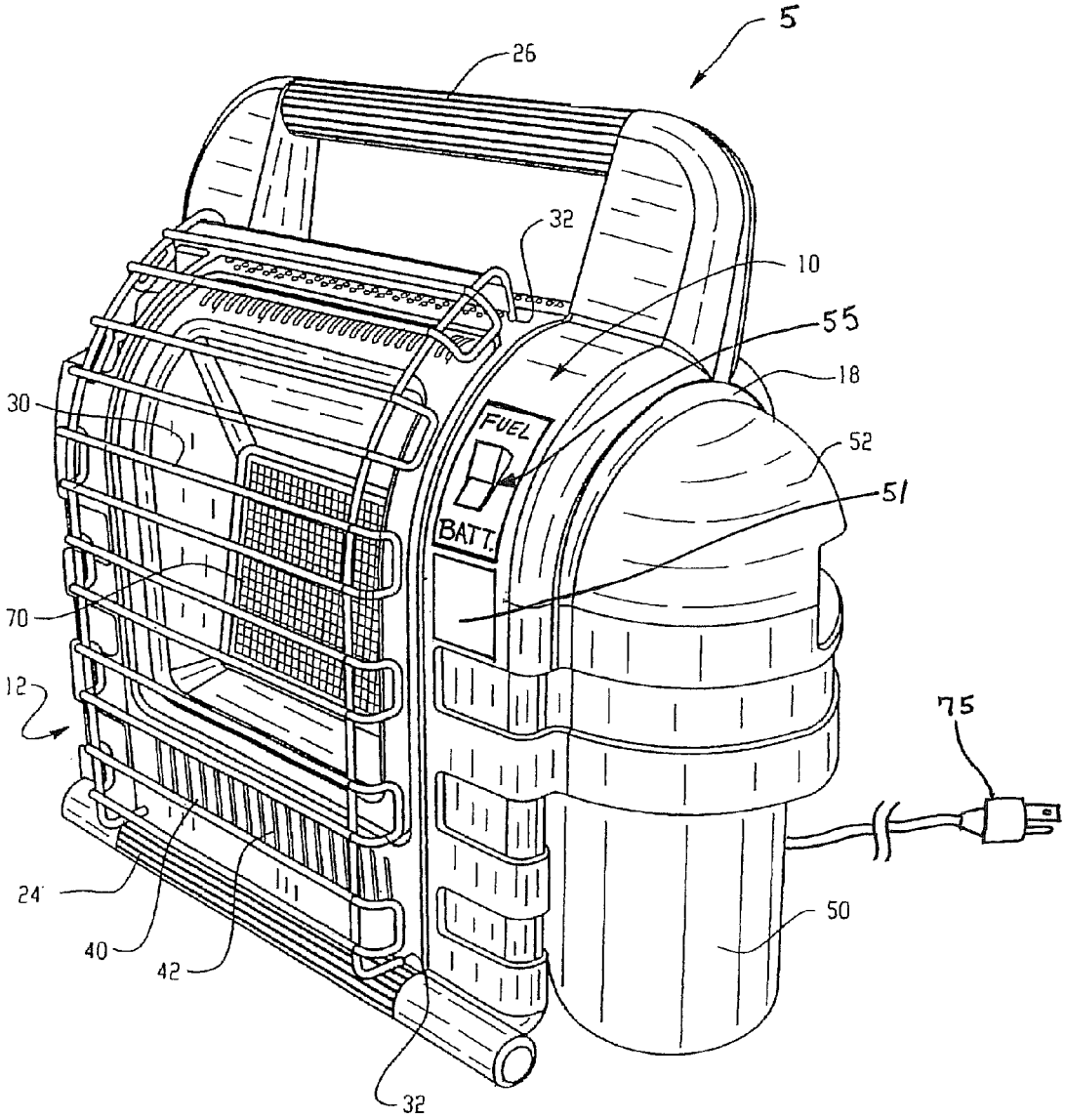
FIG. 1 is a side view of a heater including a combustible fuel source and an integrated battery in accordance with an embodiment of the present invention.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

The Figures show the novel invention of providing a high capacity, high charge rate lithium secondary cell battery or other self-contained source of electric energy (referred to generally herein as a "battery") for use as an alternative or supplemental energy source providing at least a portion of the operating or accessory power for a heating unit, lighting unit, end use application requiring the same, or any combination thereof.

A portable heating unit, hereinafter referred to as a heater 5, according to an embodiment of the present is shown in FIG. 1. The heater 5 is supported by two elongated legs 24 laterally disposed along the outboard edges of the rear face (not short) and front face 12 of the housing 10. The legs 24 are preferably grooved providing a friction surface to contact the supporting surface and preferably extend over the entire width of the housing 10 to provide a wide "footprint" and stable support area for the heater. In another embodiment (not shown), additional legs extending front to rear are provided beneath legs 24 to increase air flow beneath the heater. A handle 26 is recessed from and extends from the top of the heater 5 at an angle directed away (approximately 15 degrees) from the front face 12. The offset allows the handle to remain cool for handling by a user while the angled orientation of the handle 26 protects the user's hand from heat exiting the top of the heater 5 while the user transports the heater 5 by grasping the handle 26. The handle 26 is also grooved providing an enhanced gripping surface for the user. The heater 5 is deemed to be portable because it can easily be grasped at the handle 26 and relocated as desired by the user.

A shield or metal grid 30 is attached to the front face 12 of the heater 5 to provide protection to internal heater components. In addition, the shield 30 prevents accidental contact with hot portions of the heater's front face 12. The shield 30 can be made from any material that can withstand the elevated temperatures produced by the heater 5, such as elongated wire metal strips and peripheral pieces, which can be received in openings 32 in the housing 10 to secure the shield 30 to the heater 5. In addition, only one screw (not shown) need be removed for access to the interior components enabling easy servicing or replacement of selected components of the heater.

An opening or air inlet 40 is disposed on a lower portion of the front face 12 of the heater 5 for receiving and filtering air drawn into the housing 10. The air inlet 40 is preferably formed from a series of elongated slits 42 spaced equidistantly across the housing 10 beneath the shield 30. However, any opening that adequately allows for the influx of air into the housing 10 is within the scope of the present invention.

A fuel tank 50 is secured to and at least partially enclosed by a sleeve portion 52 of the housing 10. The fuel tank 50 is preferably a removable canister or propane tank that can be replaced by a new tank or removed, refilled, and re-installed in the housing 10. The sleeve portion 52 protrudes from the side 18 of the housing 10 and partially encloses the gas supply tank 50. The dome acts as a protective shroud to cover at least the interconnection of the fuel tank 50 with the housing 10. Other embodiments include a sleeve portion 52 in the form of a door that is pivotally coupled to the housing 10 by at least one hinge (not shown) to allow the door to be opened to expose the fuel tank 50. The fuel tank 50 can store any type of combustible fuel that can be ignited by the heater 5 as described below to generate thermal energy for heating an ambient environment in which the heater 5 is located. For example, a one pound propane cylinder can be removably coupled to the heater 5 to provide approximately six hours of continuous fuel supply to the heater 5. Alternately, the heater 5 can be supplied, for example, by a conventional twenty pound propane tank (not shown) having an extended length hose assembly so that the tank can be located away from the heated region. For instance, the twenty pound propane tank can be positioned outside a tent, cabin, fishing shanty garage, etc. while the heater 5 is located within the structure to provide on the order of one hundred and ten hours of heat with the twenty pound supply tank. Although described as a propane tank, the fuel tank 50 can store any type of combustible fuel that can be ignited by an ignition source such as a flame or spark to generate thermal energy to be emitted by the heater 5.

The fuel tank 50 is connected to a regulator which connects to a valve and orifice (not shown) in a known manner, said orifice being selectively adjustable between open and closed positions. At least a portion of the regulator or other feature facilitating the connection of the fuel tank 50 to the heater 5 can optionally be pivoted, rotated, or otherwise adjusted to ease installation of the fuel tank 50 to the heater 5. Examples of suitable configurations to establish a pivotal connection between a fuel tank 50 and the heater 5 are similar to the pivotal connections disclosed in U.S. Pat. Nos. 6,742,814 and 6,792,937, each of which are incorporated in their entireties herein by reference.

Figure 2:
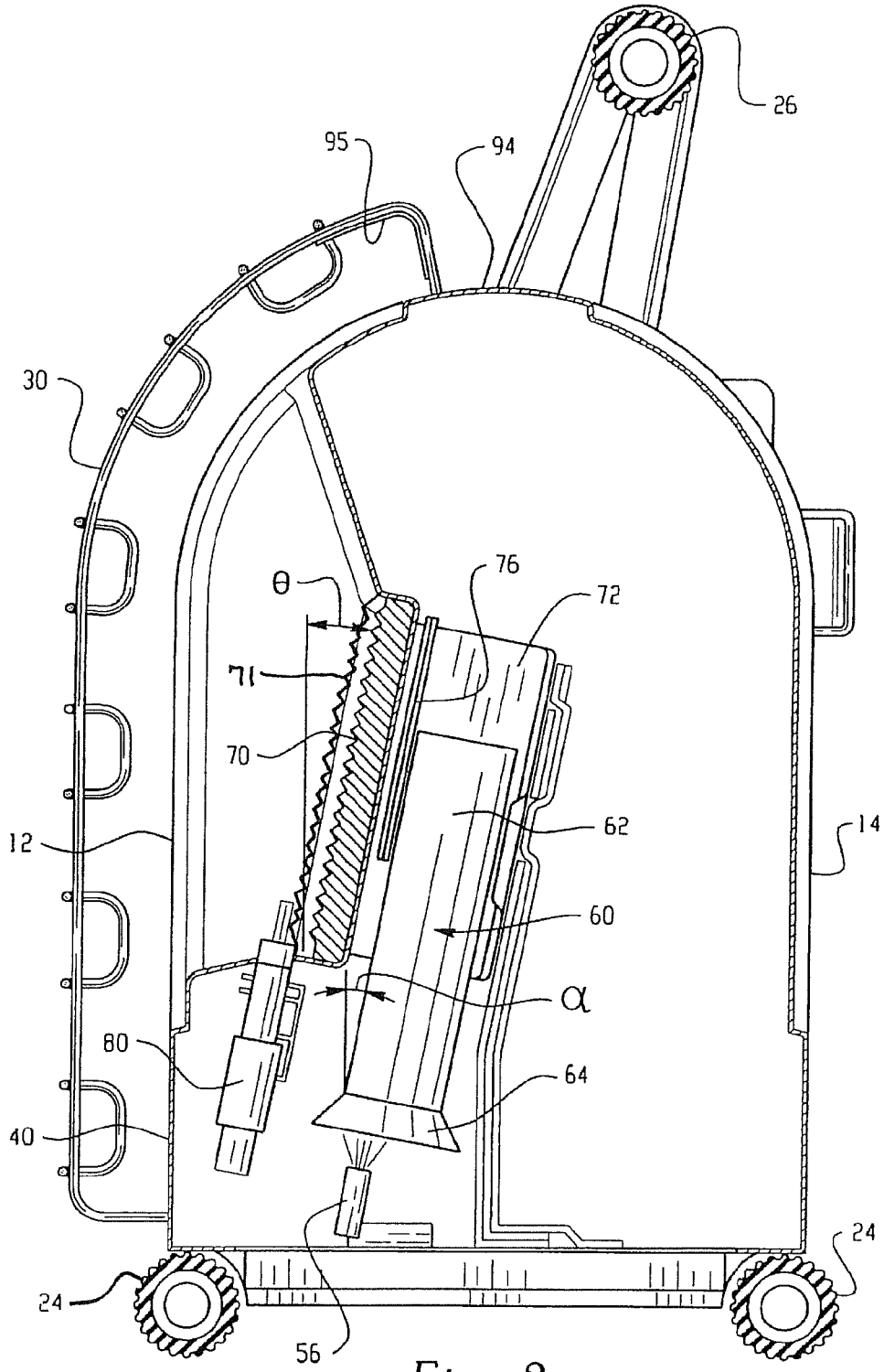
FIG. 2 is a cutaway side view of a heater including a combustion feature for generating thermal energy from the combustion of a combustible fuel and an electric heating element for generating thermal energy from electric energy stored in a battery provided to the heater in accordance with an embodiment of the present invention.

With reference to FIG. 2, a burner venturi 60 is enclosed within the housing 10 and operates to mix oxygen and propane or other fuel from the fuel tank 50 for combustion. The burner venturi 60 has a hollow generally cylindrical body 62 and a tapered mouth 64 having a wider diameter than the body 62. The burner venturi 60 is disposed at an angle $\alpha$ relative to the longitudinal axis of the heater 5. The mouth 64 of the burner venturi 60 is positioned on approximately the same axial plane as the air inlet 40 and the cylindrical body 62 extends upwardly from the mouth 64. The orifice 56 which is operatively coupled to receive fuel from the fuel tank 50 is located directly beneath the mouth 64 of the burner venturi 60.

Also located within the housing 10 is a generally planar radiant surface 70 disposed at an angle $\theta$ relative to the longitudinal axis of the heater 5. A rear face of the radiant surface 70 is in communication with a cavity or plenum chamber 72. The plenum chamber 72 receives the air/fuel mixture from the venturi 60 and distributes the mixture over and through small openings formed in the rear face of the radiant surface 70. Thus, in operation, the orifice 56, which is operatively coupled to the fuel tank 50 to receive fuel therefrom, is opened releasing the gaseous fuel such as propane into the mouth of the burner venturi 60.

Other embodiments can alternately combust a liquid fuel that is injected as fine droplets or a mist into the plenum chamber 72 instead of the gaseous fuel. Such embodiments will include features chosen with sound engineering judgment that facilitate the combustion of the atomized fuel from the fuel tank 50 instead of gaseous fuel. However, for the sake of clarity, the present invention will be further described as consuming a gaseous fuel from the fuel tank 50.

Associated with the orifice 56 is a regulator (not shown) that reduces the delivery pressure of the fuel gas from the fuel tank 50 (rated up to 150 psi) to eleven inches of water column in one stage. Thus, the portable heater 5 operates at a significantly lower pressure than existing commercially available units. The stream of gas exiting the orifice 56 creates a vacuum effect drawing air from the air inlet 40 into the mouth 64 of the burner venturi 60. Propane and air are thoroughly mixed in the burner venturi 60 and plenum chamber 72 in order to promote complete combustion and produce a clean burning infrared heating surface 70. The mixture of oxygen and propane travels upward through the cylindrical body 62 of the burner venturi 60 until reaching the plenum chamber 72. To prevent the mixture of propane and oxygen from immediately exiting the plenum chamber 72, a solid baffle 76 is provided which forces the air/gas mixture downward into communication with the rear face of the radiant surface 70.

The radiant surface 70 may be a burner tile or a multi-ply screens (not shown) that define a plurality of small openings which permit combustion of the air/gas mixture as it passes therethrough. An ignition source is provided for initially sparking or igniting the air/fuel mixture at the radiant surface 70. Embodiments of the present invention include a container 80 that houses a pilot 82 and the igniter, such as that disclosed in U.S. Pat. No. 6,648,635, for example, which provides the initial sparking. However, it will be appreciated that any conventional means for initially sparking or igniting the air/fuel mixture can be utilized without departing from the scope of the present invention. Combustion of the air/gas mixture is maintained and reaches elevated temperatures of approximately 1200° F. Embodiments of the heater 5 are rated at a minimum 4000 BTUs and a maximum 9000 BTUs at eleven inches water column pressure. Other ratings below 12,000 BTUs are also potential alternatives.

The embodiment of the heater 5 shown in FIG. 1 further includes a battery 51 or other self-contained source of electric energy (hereinafter the "battery") that is at least partially enclosed by the housing 10 of the heater 5. According to alternate embodiments, the battery 51 can be operatively coupled to an exterior portion of the housing 10 or otherwise positioned adjacent to the housing 10. But regardless of the location of the battery 51 relative to the housing 10, the battery 51 can suitably supply electric energy to be converted by the heater 5 into thermal energy for heating the ambient environment in which the heater 5 is located.

A resistive heating element 71, shown best in FIG. 2, is provided adjacent to the heating surface 70 that emits thermal energy as an elevated temperature generated from the combustion of the fuel from the fuel tank 50. Although the resistive heating element 71 is shown positioned between the heating surface 70 and the shield 30, it is understood that the resistive heating element 71 can be positioned anywhere in the heater 5 from where it can emit heat to heat the ambient environment of the heater 5. For example, the resistive heating element 71 can be positioned side by side with the heating surface 70 that emits heat from the combustion of the fuel from the fuel tank 50. Other embodiments include a resistive heating element 71 that is integrally formed with the heating surface 70, a resistive heating element 71 that extends through the small openings formed in the heating surface 70, or any other suitable arrangement of the resistive heating element 71 relative to the heating surface 70. Further, electric heating elements other than merely resistive heating elements are also included within the scope of the present invention.

The battery 51 can optionally be used as the sole source of electric energy for the heater 5 for a limited or extended period of time. The battery can alternately be utilized as the primary source of electric energy of the heater 5 in conjunction with another source of electric energy, such as a conventional electric wall outlet for example, or as a back-up supply of electric energy when the other source of electric energy fails or is exhausted, for example. When the other source of electric energy, such as alternating current ("AC") mains power from a conventional wall outlet is available, the other source of electric energy can supply the electric energy required by the heater 5 and simultaneously charge the battery 51, if needed. To facilitate a conductive path between the wall outlet or other source of electric energy a plug 75 (FIG. 1) can optionally extend outwardly from the housing 10, and can also optionally be coiled around a spool (not shown) disposed within the housing 10 for storage.

The battery 51 can selectively supply electric energy to energize the resistive heating element 71, which converts the electric energy into thermal energy emitted as heat by the heater 5 to raise the temperature in its ambient environment. An example of a suitable battery 51 for supplying electric energy to the resistive heating element 71 is a lithium secondary cell battery (also commonly called a lithium ion battery), which is disclosed in more detail in United States Patent Publication No. US 2005/0233219, published on Oct. 20, 2005, which is incorporated in its entirety herein by reference. Another example of a suitable battery 51 is described in detail in United States Publication No. US 2005/0233220, published on Oct. 20, 2005, which is also incorporated in its entirety herein by reference. These, or batteries with similar performance characteristics may be utilized in the heating or lighting unit in conjunction with this invention. Yet other embodiments can optionally include other self contained sources of electric energy, such as fuel cells and the like.

The aforementioned examples of batteries 51 that could optionally be used to energize the resistive heating element 71 of the present invention contains a high-capacity lithium-containing positive electrode in electronic contact with a positive electrode current collector. A high-capacity negative electrode is in electronic contact with a negative electrode collector. The positive and negative collectors are in electrical contact with separate external circuits. A separator is positioned in ionic contact between with the cathode (positive terminal) and the anode (negative terminal), and an electrolyte is in ionic contact with the positive and negative electrodes. The slow discharge rates of the battery allow for extended shelf-life and extended use characteristics.

The total and relative area specific impedances for the positive and negative electrodes of such exemplary batteries 51 are such that the negative electrode potential is above the potential of metallic lithium during charging at greater than or equal to 4 C (4 times the rated capacity of the battery per hour). The current capacity per unit area of the positive and negative electrodes each are at least 3 mA-h/cm2 and the total area specific impedance for the cell is less than about 20 Ω-cm2. The ratio of the area specific impedances of the positive electrode to the negative electrode is at least about ten.

Also, for the batteries 51 listed as examples above, the area specific impedance of the total cell is localized predominantly at the positive electrode. The charge capacity per unit area of the positive and negative electrodes each are preferably at least 0.75 mA-h/cm2, more preferably at least 1.0 mA-h/cm2, and most preferably at least 1.5 mA-h/cm2. The total area specific impedance for the cell is less than about 16 Ω-cm2, preferably less than about 14 Ω-cm2, and more preferably less than about 12 Ω-cm2, more preferably less than about 10 Ω-cm2, and most preferably less than or equal to about 3 Ω-cm2. The negative electrode has an area specific impedance of less than or equal to about 2.5 Ω-cm2, more preferably less than or equal to about 2.0 Ω-cm2, and most preferably less than or equal to about 1.5 Ω-cm2.

Examples of suitable materials for the positive electrode include a lithium transition metal phosphate including one or more of vanadium, chromium, manganese, iron, cobalt, and nickel. Examples of suitable negative electrode materials include carbon, such as graphitic carbon. The carbon is selected from the group consisting of graphite, spheroidal graphite, mesocarbon microbeads and carbon fibers.

Figure 5:
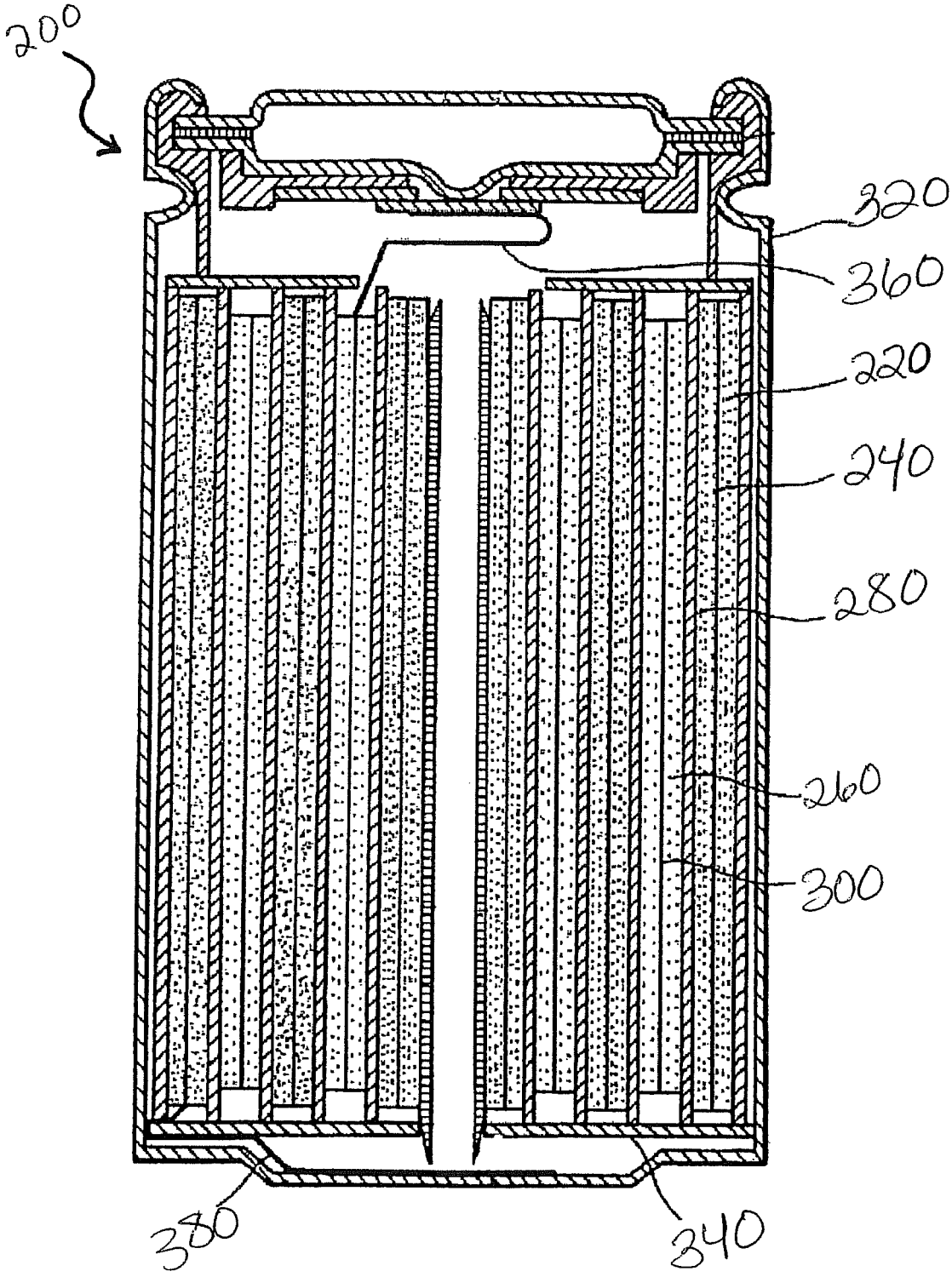
FIG. 5 is a cutaway view of an example of a battery that can be provided to a heater in accordance with an embodiment of the present invention.

Embodiments of the battery 51 can optionally include a battery element having an elongated cathode and an elongated anode, which are separated by two layers of an elongated microporous separator which are tightly wound together and placed in a battery can. An example of a typical spiral electrode secondary cell is shown in FIG. 5, which was reproduced from U.S. Patent Publication 2005/0233219 and U.S. Pat. No. 6,277,522, both of which are incorporated in their entirety herein by reference. The secondary cell 200 includes a double layer of anode material 220 coated onto both sides of an anode collector 240, a separator 260 and a double layer of cathode material 280 coated onto both sides of cathode collector 300 that have been stacked in this order and wound to make a spiral form. The spirally wound cell is inserted into a battery can 320 and insulating plates 340 are disposed at upper and lower surfaces of the spirally wound cell. A cathode lead 360 from anode collector 300 provides electrical contact with the cover. An anode lead 380 is connected to the battery can 320. An electrolytic solution is also added to the can.

The battery 51 utilized to energize the resistive heating element 71 of the present invention is optionally rechargeable. Further, some embodiments include a battery 51 that minimizes lithium plating during charging of the battery 51 to avoid decreasing the capacity loss during charge cycles. The cell used for an embodiment of the present invention is capable of achieving at least about 80% state of charge within about 25 minutes, and the cell is capable of multiple charge/discharge cycles with a capacity loss of less than an about 0.2% per cycle. The battery 51 can optionally have a charge rate greater than or equal to 4 C, and charges to at least a 95% state of charge in less than 15 minutes. Other embodiments include a battery 51 that is a one-time-use cell without recharging capabilities with performance features that are approximately equivalent to those described above.

The battery 51 allows for operation of the heater 5 in different modes. In a manual mode, an operator can select to generate the thermal energy required to heat the ambient environment of the heater 5 by combusting fuel from the fuel tank 50, energizing the resistive heating element 71 with electric energy from the battery 51, or a combination thereof. The operational mode of the heater 5 can be selected by the operator by toggling a switch 55 between a plurality of available operating modes. The switch can be any type of operator input device, such as a multi-position switch, one or more push button switches, and the like.

In use, the switch 55 can be manually adjusted to the BATT. position by the operator as shown in FIG. 1. In this position, the switch 55 causes a conductive path to be established between the battery 51 and the resistive heating element 71, thereby causing the resistive heating element 71 to convert the electric energy to thermal energy. The thermal energy generated by the resistive heating element 71 is given off as heat from the heater 5, thereby elevating the temperature of the ambient environment in which the heater 5 is located.

If the operator manually adjusts the switch 55 to the FUEL position (toggled in the opposite direction as shown in FIG. 1), the conductive pathway between the battery 51 and the resistive heating element 71 is interrupted. This terminates the conversion of electric energy from the battery 51 by the resistive heating element 71 into thermal energy, and instead, activates the generation of thermal energy by combusting the fuel from the fuel tank 50. The combustion of the fuel from the fuel tank using the heating surface 70 is described in detail above.

The operator can optionally be presented with the option of generating thermal energy to heat the heater's ambient environment by converting electric energy from the battery 51 and by combusting fuel from the fuel tank 50 simultaneously. To generate thermal energy in such a manner, the operator can manually adjust the switch 55 to a position between the BATT. and FUEL positions. During operation of the heater 5 in such a case, the conductive pathway between the battery 51 and the resistive heating element 71 is established and combustion of the fuel from the fuel talk 50 also occurs.

The heater 5 can also optionally be operated in an automatic mode, wherein thermal energy is generated from a primary source, and the generation of thermal energy is automatically switched to a secondary source when the primary source is no longer available or has otherwise failed. Selection of the automatic mode can manually selected by the operator with a switch analogous to the switch 55, or automatic mode can be a default setting such as when the switch is adjusted to the FUEL position.

For example, consider the circumstance where the heater 5 is generating thermal energy from the combustion of fuel from the fuel tank 50 as the primary source, and the electric energy is the secondary source. When the fuel tank 50 eventually runs out of fuel, the combustion of fuel can be discontinued and the conductive path between the battery 51 and the resistive heating element 71 can be automatically established without intervention by the operator. According to other embodiments of the present invention, the heater 5 may be automated to switch to the appropriate mode of operation for a given condition. The heater 5 can include any appropriate control hardware and embedded software to select the battery 51 or the combustible fuel depending upon which energy source is available. The heater 5 can further be automated to sense levels of carbon monoxide or other indoor air pollution in the local vicinity of the heater 5. When predetermined levels of pollution or carbon monoxide sensed by the heater 5 become unsafe or otherwise exceed threshold levels, the heater 5 can automatically switch to convert electric energy from the battery 51 instead of the combustible fuel to generate thermal energy.

Figure 3:
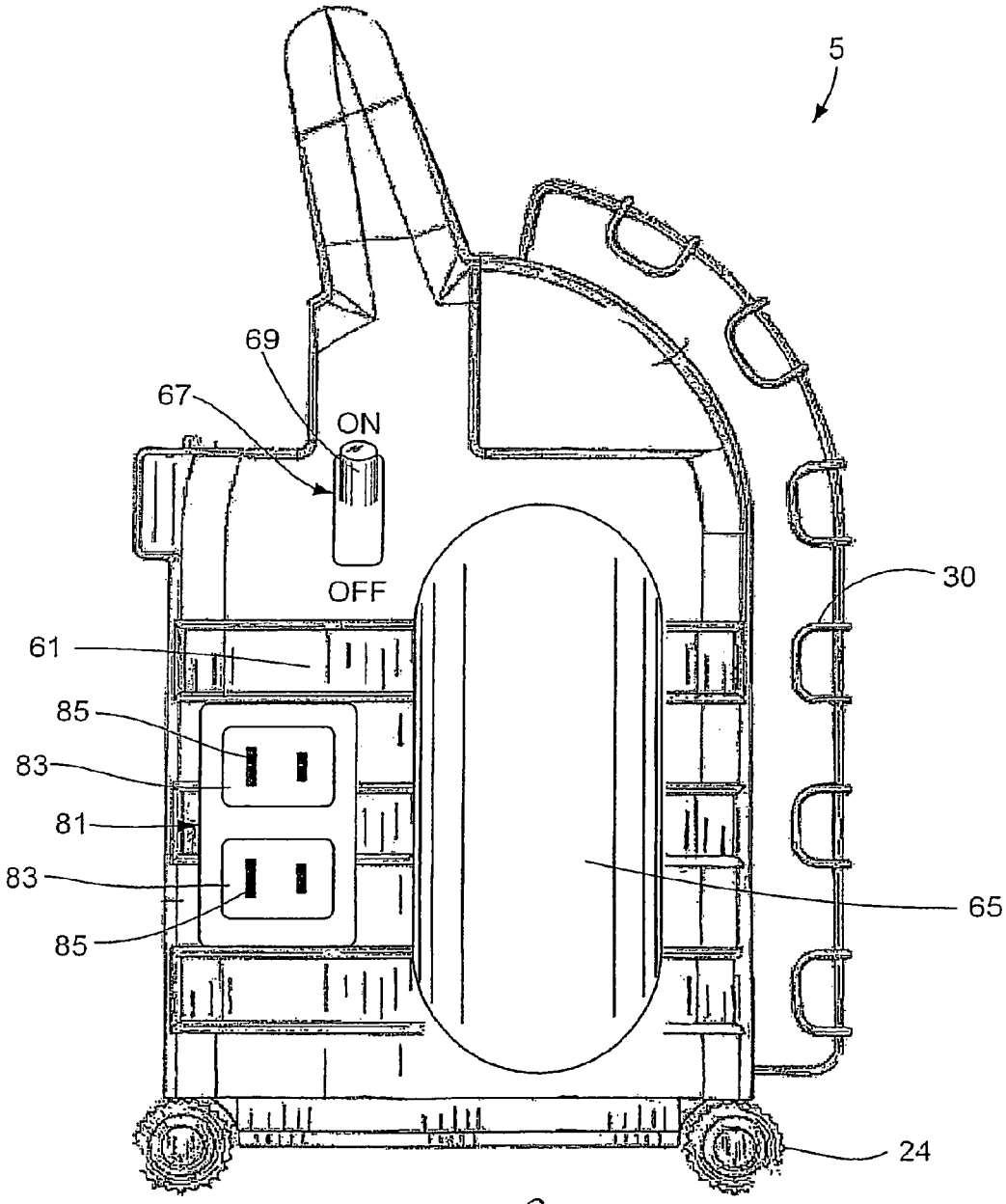
FIG. 3 is a side view of an opposite side of the heater shown in FIG. 1, wherein the heater includes a light and an electric outlet into which external electric devices can be plugged to be energized from electric energy stored by the battery in accordance with an embodiment of the present invention.

Use of the electric energy from the battery 51 of the present invention is not limited to being converted into thermal energy for heating the ambient environment of the heater 5. Instead, the heater 5 can optionally include one or more accessory features that can be energized by electric energy. Alternate embodiments of the heater 5 can optionally include one or more accessories including, but not limited to a fan, blower, light, thermostat, electric igniter, or any combination thereof, for example. The battery 51 of the present invention can supply sufficient amounts of electric energy to energize the resistive heating element 71 alone, or simultaneously in combination with one or more of the aforementioned accessories. For instance, FIG. 3 illustrates a side 61 of the heater 5 opposite the side 18 of the heater 5 on which the fuel tank 50 is located. A light 65 is provided to extend outwardly beyond the side 61 of the heater 5. The light can be any conventional light including, but not limited to a fluorescent light, incandescent light, high-intensity light emitting diode ("LED") array, and the like. A clear or slightly opaque protective shroud or lens can conceal the light 65 and protect it from damage from hazards in the environment in which the heater 5 is located. Further, operation of the light 65 can be controlled by the operator with a switch 67 independent of the operation of the resistive heating element 71 and the combustion of fuel from the fuel tank 50. The switch 67 can be any multi-position switch, and can be similar to the switch 55 discussed above. In FIG. 3, the switch 67 is a simple two position switch that can be toggled between ON and OFF states by adjusting the position of a lever 69. According to alternate embodiments, the switch 67 can optionally have a plurality of intensity settings, such as low, medium and high, or can be controlled with an infinitely adjustable dimmer switch.

But regardless of the mode of operation of the light 65, the electric energy necessary for the light's operation can be supplied by the battery 51, an AC source such as a conventional wall outlet through the plug 75, or a combination thereof. For any source of electric energy, a suitable converter (not shown) can be disposed within the housing 10 to deliver the appropriate type of electric energy required by the light 65. For example, the electric energy supplied by the battery 51 is of the direct current ("DC") variety. However, if the light 65 operates off of AC electric energy, an inverter (not shown) can be disposed electrically between the battery 51 and the light 65. An inverter is merely a DC/AC converter that converts DC electric energy into AC.

Likewise, if the light 65 operates off of DC electric energy and AC electric energy is being supplied to the heater 5 through the plug 75 from a conventional wall outlet, a rectifier (not shown) can be disposed electrically between the plug 75 and the light 65. Further, a rectifier, which is merely an AC/DC converter that converts AC electric energy into DC, can optionally be provided to the heater 5 for converting AC electric energy from a conventional wall outlet into DC electric energy for charging the battery 51.

The embodiment of the heater 5 shown in FIG. 3 further includes an optional electric energy outlet 81 into which external electric accessories such as radios, clocks, power tools and the like can be plugged. The outlet 81 includes one or more female receptacles 83 that can receive conventional two-prong electric power cord plugs. Accordingly, each receptacle 83 includes two apertures 85 into which the prongs of the plug provided to the external electric accessory are inserted to establish an electrical connection between the battery 51 and the external electric accessory. Due to the large power output capacity of batteries 51 such as those described above, some of which can output up to 3000 Watts, the external electric accessory can be energized by electric energy supplied from the battery 51 through the receptacle 83. Alternate embodiments of the heater 5 can optionally include one or more electric energy outlets 81 with one or more receptacles 83 having three apertures 85 to receive conventional three-prong power plugs. Yet other embodiments can optionally include an outlet 81 with one or more receptacles having any number of apertures 85 without departing from the scope of the present invention.

Thus, the battery 51 provided to the heater 5 can selectively supply electric energy to one or more of the following: a heating element 71, a fan, a blower, an electric outlet 81, a light 65, a thermostat, an electric igniter for triggering combustion of a combustible fuel, and any combination thereof. Further, the battery 51 can supply this electric energy simultaneously while combustion of the combustible fuel is taking place, or in the absence of the combustion of the combustible fuel.

Figure 4:
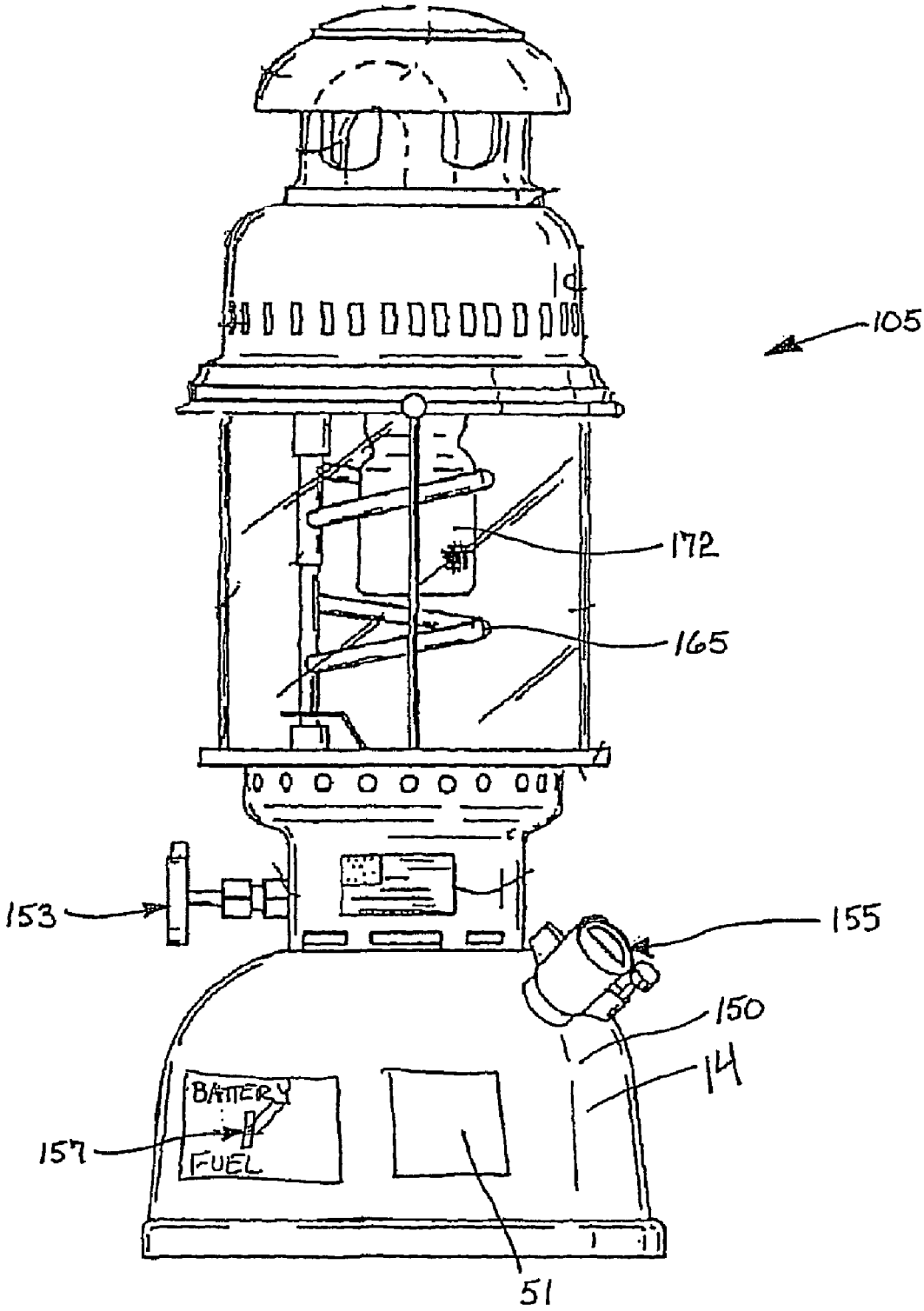
FIG. 4 is a perspective view of a lighting unit that can generate visible light from a combustible fuel and from electric energy stored by a battery in accordance with an embodiment of the present invention.

Although the heater's primary function is generating thermal energy for heating purposes, any device including a combustible fuel energy source in addition to an electric energy source such as the battery 51 are also within the scope of the present invention. For instance, FIG. 4 illustrates a lighting unit 105 that includes a light source that emits visible light from the combustion of a combustible fuel to illuminate all immediate vicinity of the lighting unit 105. A combustion chamber 172 is in fluid communication with a fuel tank 150. A combustible fuel from the fuel tank 150 is forced tinder pressure generated through the manual operation of a pump 155 into the combustion chamber, where it is ignited by an igniter (not shown). A regulator 153 is also provided to regulate the flow of the combustible fuel from the fuel tank 150 to the combustion chamber to control the magnitude of the visible light emitted by the lighting unit 105.

The lighting unit 105 further includes an electric illumination device 165 such as a light, a resistive element, and the like, that can be energized by electric energy from a battery 51, such as that described above for the heater 5 to generate the visible light. Similar to the heater 5, the lighting unit 105 includes a manually actuated switch 157 allowing the operator to select the energy source, i.e., the electric energy from the battery 51 or the combustible fuel from the fuel tank 150, to be consumed in generating the visible light.

In embodiments of the invention wherein the lithium secondary cell is fully or partially integrated with the physical structure of the heater 5 or lighting unit 105 the battery 51 may be accessible or may be inaccessible to the user. The recharging process may require the battery 51 to be removed from the heater 5 or lighting unit 105 in certain embodiments, while the battery may be recharged while integrated within the heater 5 or lighting unit 105 in other embodiments by connecting the heater 5 or lighting unit 105 to conventional electrical wall outlet via the plug 75 or other suitable device. The battery 51 may be electrically connected to the heater 5 or lighting unit 105 by a wire connection, a surface contact connection, a clip connection, or other methods of electrical connection well known in the art.

In a further embodiment of the present invention the battery 51 may be electrically connected to an interface recharging unit also connected to the heater 5 or lighting unit 105. The recharging unit will be connected such that when the combustible fuel is being combusted to generate the thermal or visible light energy, this thermal or visible light energy is converted into electrical energy used to charge the battery 51. The recharging unit may act as a generator, converting fuel or thermal energy into electrical energy. This recharging unit allows the heater 5 or lighting unit 105 to become self-recharging, thereby minimizing the external power required to recharge the battery 51 therein. The recharging unit may function by any method well known in the art, with particular non-limiting examples described below.

In one non-limiting particular embodiment of this invention that includes a recharging unit, the recharging unit may include a heat-conducting substrate composed of diamond or any other high thermal conductivity material, disposed in thermal contact with a high temperature region of the heater 5 or lighting unit 105. During operation of the heater 5 or lighting unit 105 consuming the combustible fuel, a portion of the heat generated will flow from the high temperature region into the heat-conducting substrate, from which the heat flows into an electrical power generator. A thermoelectric material such as a BiTe alloy-based film or other thermoelectric material is placed in thermal contact with the heat conducting substrate. A low temperature region is located on the side of the thermoelectric material opposite that of the high temperature region. The thermal gradient generates electrical power that can be used to recharge the lithium ion battery 51. Further details of this recharging process, and other recharging processes that may be appropriate for this invention can be found in U.S. Pat. No. 6,787,691, issued on Sep. 7, 2004 (Fleurial, et al.), or the other references listed within U.S. Pat. No. 6,787,691, all of which are incorporated in their entirety herein by reference.

A further non-limiting embodiment of the present invention that has recharging capabilities integrates a thermoelectric generator as described in U.S. Pat. No. 5,917,144 (Jun. 29, 1999; Miyake, et al.), which is incorporated in its entirety herein by reference, as the recharging unit. The thermoelectric generator of this embodiment uses catalytic combustion heat of fuel gas as a heat source for the generator, and has a construction wherein a thermoelectric element or a planar electric generation unit comprising thermoelectric elements has a construction held between the thermal input part and the heat radiation part, having fuel gas supply means and means for mixing fuel gas with air. The thermoelectric generator also has a structure such that the combustion heat can be directly supplied to the thermoelectric element by burning the mixed gas of fuel with air in a catalyst part arranged in the thermal input part, the thermal input part having a heat conductive end plate and a catalyst part which are in contact with the thermoelectric element, the face opposite to the thermoelectric element of the heat conductive end plate having a structure of convex and concave configuration with the catalyst part within the convex and concave configuration surface. Further details of the thermoelectric generator unit of this embodiment may be found in the various references listed within U.S. Pat. No. 5,917,144, all of which are incorporated in their entirety herein by reference.

More than one battery 51 may be provided within the heater 5 or lighting unit 105 for extended use of the battery 51 as a source of electrical energy. In certain aspects wherein more than one battery 51 is available, the multiple lithium ion batteries may be used as reciprocal recharging sources, wherein a first battery can provide power to the external load of the heater 5 or lighting unit 105 while also providing power to recharge a second battery 51. When the first battery is depleted to a certain voltage level, the exchanger switch may be activated and the second battery 51 can begin providing electric energy to the external load, while also directing a portion of electric energy from the second battery 51 to recharging the first battery 51. The exchanger switch allows the generator to continue providing power to the external load of the heater 5 or lighting unit 105 without interruption, while also increasing the useful life of the batteries 51. Further details and methods for utilizing more than one battery 51 to provide electric energy to the external load of the heater 5 or lighting unit 105 while acting to recharge another battery 51 can be seen in U.S. Pat. No. 6,924,567, issued Aug. 2, 2005 (Killian, et al.), or the other references cited within U.S. Pat. No. 6,924,567, all of which are incorporated in their entirety herein by reference.

Although much of the description above focuses on portable heaters, fixed heating installations such as furnaces including one or more of the features described above for use in providing thermal energy to residential, commercial or industrial structures are also within the scope of the present invention.

Illustrative embodiments have been described, hereinabove. It will be apparent to those skilled in the art that the above devices and methods may incorporate changes and modifications without departing from the general scope of this invention. It is intended to include all such modifications and alterations in so far as they come within the scope of the appended claims.

The invention claimed is:

1. An apparatus comprising:

a portable heating or lighting unit, a lithium ion battery;

a housing;

a rectifier or inverter;

an electrical device adapted to use electrical energy from said lithium ion battery, wherein said electrical device comprises a resistive heating element;

a control system comprising control hardware and embedded software, said control system being adapted to automatically control the resistive heating element;

a regulator adapted to receive fuel from an associated fluid fuel source;

an air inlet in the housing adapted to admit air into the housing;

a burner region in fluid communication with the regulator and in fluid communication with the air inlet, said burner region being adapted to produce thermal energy by combustion of an air and fuel mixture;

a thermoelectric element adapted to convert at least some of said thermal energy to produce electrical energy, said thermoelectric element comprising a BiTe alloy; and a system adapted to sense levels of carbon monoxide or other indoor air pollution in the local vicinity of the heater, said system being adapted to stop the combustion of the air and fuel mixture at some level of said carbon monoxide or other indoor air pollution.

2. The portable heater of claim 1, further comprising a fluorescent light, an incandescent light, a light emitting diode, a fan, a blower, a thermostat, an electric igniter, an electric energy outlet, or a combination thereof.

3. The portable heater of claim 2, wherein said housing comprises a handle; or a leg for supporting the heater; or a shield or grid.

4. A portable heating unit comprising:

a housing;

a regulator adapted to receive fuel from an associated fluid fuel source;

air inlet in the housing adapted to admit air into the housing;

a burner region in fluid communication with the regulator and in fluid communication with the air inlet, said burner region being adapted to produce thermal energy by combustion of an air and fuel mixture;

a thermoelectric element adapted to convert at least some of said thermal energy to produce electrical energy;

a lithium ion battery adapted to store at least some of said electrical energy produced by said thermoelectric element and further adapted to output stored energy as electrical energy;

an electrical device adapted to use electrical energy from said battery or from said thermoelectric element; and a system adapted to sense levels of carbon monoxide or other indoor air pollution in the local vicinity of the heater, said system being adapted to stop the combustion of the air and fuel mixture at some level of said carbon monoxide or other indoor air pollution.

5. The portable heating unit of claim 4, wherein said fluid fuel is propane.

6. The portable heating unit of claim 5, wherein said electrical device comprises a resistive heating element.

7. The portable heating unit of claim 6, further comprising a rectifier or inverter.

8. The portable heating unit of claim 7, further comprising a fluorescent light, an incandescent light, a light emitting diode, a fan, a blower, a thermostat, an electric igniter, an electric energy outlet, or a combination thereof.

9. The portable heating unit of claim 8, wherein said thermoelectric element comprises a BiTe alloy.

10. The portable heating unit of claim 9, further comprising a control system comprising control hardware and embedded software, said control system being adapted to automatically control the resistive heating element.

11. The portable heating unit of claim 10, wherein said lithium ion battery comprises, a positive electrode, wherein the positive electrode of said battery comprises a lithium transition metal phosphate selected from the group consisting of vanadium, chromium, manganese, iron, cobalt, nickel, and combinations thereof;

wherein the battery comprises, a negative electrode, wherein the negative electrode of said battery comprises a form of carbon selected from the group consisting of graphite, spheroidal graphite, mesocarbon microbeads, carbon fibers, and combinations thereof;

wherein the charge capacity per unit area of the positive and negative electrodes of the battery are each at least 1.5 mA-h/cm$^2$; and wherein the total area specific impedance of the battery is less than about 3 ohm-cm$^2$.

12. The portable heating unit of claim 11, further comprising a fuel cell, or a plug adapted to draw electrical energy from a wall outlet or other source of electrical energy.

13. A method of providing heat comprising:

providing a portable heating unit, said portable heating unit comprising:

a housing;

a regulator adapted to receive fuel from an associated fluid fuel source;

air inlet in the housing adapted to admit air into the housing;

a burner region in fluid communication with the regulator and in fluid communication with the air inlet, said burner region being adapted to produce thermal energy by combustion of an air and fuel mixture;

a thermoelectric element adapted to convert at least some of said thermal energy to produce electrical energy, wherein said thermoelectric element comprises a BiTe alloy;

a lithium ion battery adapted to store at least some of said electrical energy produced by said thermoelectric element and further adapted to output stored energy as electrical energy;

a rectifier or inverter;

an electrical device adapted to use electrical energy from said battery or from said thermoelectric element, said electrical device comprising a resistive heating element, and a fluorescent light, an incandescent light, a light emitting diode, a fan, a blower, a thermostat, an electric igniter, an electric energy outlet, or a combination thereof;

a system adapted to sense levels of carbon monoxide or other indoor air pollution in the local vicinity of the heater, said system being adapted to stop the combustion of the air and fuel mixture at some level of said carbon monoxide or other indoor air pollution; and a control system comprising control hardware and embedded software, said control system being adapted to automatically control the resistive heating element;

providing an associated fluid fuel source;

fluidly engaging said associated fuel source with said regulator;

supplying fluid fuel to said regulator;

mixing air and fuel to form an air and fuel mixture;

combusting said air and fuel mixture in the burner region to produce thermal energy;

converting at least some of said thermal energy into electrical energy using aid thermoelectric element;

providing at least some of said electrical energy to said resistive heating element; and converting said electrical energy to heat with said resistive heating element.

14. The method of claim 13, wherein said lithium ion battery comprises a positive electrode, wherein the positive electrode of said battery comprises a lithium transition metal phosphate selected from the group consisting of vanadium, chromium, manganese, iron, cobalt, nickel, and combinations thereof;

wherein said lithium ion battery comprises a negative electrode, wherein the negative electrode of said battery comprises a form of carbon selected from the group consisting of graphite, spheroidal graphite, mesocarbon microbeads, carbon fibers, and combinations thereof;

wherein the charge capacity per unit area of the positive and negative electrodes of the battery are each at least 1.5 mA-h/cm$^2$; and wherein the total area specific impedance of the battery is less than about 3 ohm-cm$^2$.

* * * * *